United States Patent [19]

Sarid et al.

[11] 4,057,723

[45] Nov. 8, 1977

[54] COMPACT CORONA CHARGING DEVICE

[75] Inventors: Dror Sarid; Brian E. Springett, both of Rochester, N.Y.

[73] Assignee: Xerox Corporation, Stamford, Conn.

[21] Appl. No.: 651,769

[22] Filed: Jan. 23, 1976

[51] Int. Cl.[2] ..... H05F 3/04; H01J 1/14

[52] U.S. Cl. ..... 250/326; 361/225

[58] Field of Search ..... 250/326, 324, 325; 317/262 A, 2 R

[56] References Cited

U.S. PATENT DOCUMENTS

| | | | |
|---|---|---|---|
| 2,777,957 | 1/1957 | Walkup | 250/325 |
| 2,879,396 | 3/1959 | McDonald | 250/324 |
| 3,133,193 | 5/1964 | Guillotte et al. | 250/324 |
| 3,240,933 | 3/1966 | Reinke | 250/324 |
| 3,492,476 | 1/1970 | Germanos | 250/326 |
| 3,634,726 | 1/1972 | Jay | 317/2 R |
| 3,789,278 | 1/1974 | Bingham et al. | 250/326 |

*Primary Examiner*—Alfred E. Smith

*Assistant Examiner*—T. N. Grigsby

[57] ABSTRACT

A corona discharge device including a corona discharge electrode in contact or closely spaced from a conductive shield electrode, the discharge electrode comprising a conductive wire coated with a relatively thick dielectric material so as to prevent the flow of conduction current therethrough. When the electrode is spaced from the shield, it is supported along its length on a dielectric surface and when it is in contact with the shield, the shield itself may provide the lengthwise support for the wire, or the support may alternatively be provided by a dielectric substrate on which the shield is carried. The delivery of charge to the photoconductive surface is accomplished by means of electric field separation of charges produced by the discharge electrode. These charges are produced by an alternating voltage applied to the discharge electrode. The flow of charge to the surface to be charged is regulated by means of a d.c. voltage bias applied to the shield electrode.

24 Claims, 6 Drawing Figures

COMPACT CORONA CHARGING DEVICE

BACKGROUND OF THE INVENTION

The present invention relates to a corona charging device for depositing charge on an adjacent surface. More particularly, it is directed to a corona charging arrangement usable in a xerographic reproduction system for generating a flow of ions onto an adjacent imaging surface for altering or changing the electrostatic charge thereon. Still more particularly, this invention is directed to an improved configuration for a corona discharge device of the type disclosed in Patent Application Ser. No. 596,656, filed July 4, 1975, in the joint names of T. Davis and G. Safford, and commonly assigned.

In the electrophotographic reproducing arts, it is necessary to deposit a uniform electrostatic charge on an imaging surface, which charge is subsequently selectively dissipated by exposure to an information containing optical image to form an electrostatic latent image. The electrostatic latent image may then be developed and the developed image transferred to a support surface to form a final copy of the original document.

In addition to precharging the imaging surface of a xerographic system prior to exposure, corona devices are used to perform a variety of other functions in the xerographic process. For example, corona devices aid in the transfer of an electrostatic toner image from a reusable photoreceptor to a transfer member, the tacking and detacking of paper to the imaging member, the conditioning of the imaging surface prior, during, and after the deposition of toner thereon to improve the quality of the xerographic copy produced thereby. Both d.c. (d.c. potential connected to the coronode) and a.c. (a.c. potential connected to the coronode) type corona devices are used to perform many of the above functions.

The conventional form of corona discharge device for use in reproduction system of the above type is shown generally in U.S. Pat. No. 2,836,725 in which a conductive corona electrode in the form of an elongated wire is connected to a corona generating d.c. voltage. The wire is partially surrounded by a conductive shield which is usually electrically grounded. The surface to be charged is spaced from the wire on the side opposite the shield and is mounted on a grounded substrate. Alternately, a corona device of the above type may be biased in a manner taught in U.S. Pat. No. 2,879,395 wherein an a.c. corona generating potential is applied to the conductive wire electrode and a d.c. potential is applied to the conductive shield partially surrounding the electrode to regulate the flow of ions from the electrode to the surface to be charged. Other biasing arrangements are known in the prior art and will not be discussed in great detail herein.

Several problems have been historically associated with such corona devices. One major problem has been their inability to deposit a relatively uniform negative charge on an imaging surface. Another problem has been the growth of chemical compounds on the coronode which eventually degrades the operation of the corona device. Yet another problem has been the degradation in charging output resulting from toner accumulations on the coronode and surrounding shield structure. One still further problem is wire vibration which leads to arcing and wire fracture. These problems, among others, are specifically addressed in the aforementioned application in which there is proposed a novel corona discharge configuration which substantially reduces or alleviates the problems noted above, and other problems associated with prior art corona devices, as is discussed more fully therein.

By way of summary, the aforementioned application discloses a novel corona device for use in electrostatic reproduction machines which comprise a corona discharge wire coated with a relatively thick dielectric coating, the thickness of the coating being sufficient to prevent the flow of conduction current from the wire. Generation of charge is accomplished by means of a voltage at the dielectric surface established by capacitative coupling through the dielectric material. The magnitude of the flow of charge to the surface to be charges is regulated by the application of a d.c. bias potential to a conductive shield adjacent or contigous to the electrode.

While the above-noted corona device disclosed in Ser. No. 595,656 solves many problems associated with other known corona devices, it is desireable to provide a corona device which operates to produce higher charging currents for given operating potentials. Higher current levels in prior art devices are usually obtained by raising the operating voltages of the corona devices. As is well known in the art, corona devices when operated at relatively high potentials generate a greater amount of ozone, which may become a health hazard, if not properly controlled. Thus, higher operating voltage levels tend to produce higher ozone levels. For this reason, it would be an advantage to produce a corona device which provides a given charging current at lower energizing potential than possible with prior art devices. In addition, however, lower energizing potentials are an advantage in themselves by simplifying and reducing the cost and complexity of power supplies, insulation, etc.

A further disadvantage of conventional prior art corona discharge devices (which problem is shared by the improved corona device of application Ser. No. 595,656) results from the fact that the corona electrode or wire of such devices is commonly suspended between dielectric support blocks at the opposite ends of the device. This has the first disadvantage of setting a lower limit on the diameter of the electrode since it must have sufficient tensile strength to be supported in taut condition, and to remain in the same relative position over varying operating conditions. Expansion coefficients are also of obvious concern in selecting a suitable electrode for such prior art corona devices. Furthermore, an electrode suspended in the above manner tends to vibrate due to the high electric fields in which it is suspended. Another disadvantage resulting from the suspension of the coronode in a taut condition between supports blocks is that the wire itself is difficult to clean by abrasion.

A further disadvantage of known corona devices is that they are relatively bulky. This is due firstly to the unused space required between the coronode and the surrounding shield structure and secondly to the shield structure itself, which generally has a U-shaped cross section to partially enclose the coronode.

OBJECTS AND SUMMARY

It is therefore an object of this invention to provide a more compact configuration for a corona device and particularly a more compact corona device of the type disclosed in application Ser. No. 595,656.

It is a further object to provide a corona device in which the corona electrode or coronode is not subject to vibration by being loosely suspended in an electric field.

A further object is to provide an arrangement wherein the coronode is fixedly supported along its length to provide a rigid surface more easily cleaned and more accurately positioned.

Yet a further object is to provide a corona device which operates to generate a given level of charging current at operating voltages less than those needed in conventional corona devices and less than required in the configuration disclosed in the aforementioned Ser. No. 595,656.

Yet a further object is to provide a corona device which generates less ozone than prior art devices.

These and other objects are attained according to the invention by a corona discharge device including a corona discharge electrode and a conductive biasing member or shield located adjacent to the electrode, the electrode comprising a wire coated with relatively thick dielectric material so as to allow only a negligible flow of conduction current therethrough. The generation of charge is accomplished by means of a voltage established at the dielectric surface by capacitative coupling through the dielectric material. The flow of charge to the surface to be charged is regulated by means of a d.c. bias applied to a conductive biasing member which establishes a d.c. electric field between the surface to be charged and the member to direct or sweep the desired charge onto the surface. The electrode is located in contact, along substantially its entire length, with a support surface, which may be either insulating or conductive. If the support member is conductive it may also be biased to perform a control function. If the support surface is a dielectric, a conductive member must be loacted in very close proximity to the electrode, as described hereinafter. The biasing member may take the form of a flat conductive plate which itself supports the electrode but is insulated from the wire by the dielectric coating. Alternately, the biasing member may comprise a thin conductive member which is supported by a dielectric support block, the support block serving to render the device safer to handle and service by preventing contact with the biased member. The biasing conductive members may be continuous or segmented or otherwise so long as they are positioned sufficiently proximate the electrode as discussed in greater detail hereinafter.

DESCRIPTION OF THE PREFERRED EMBODIMENT

Figure 1:
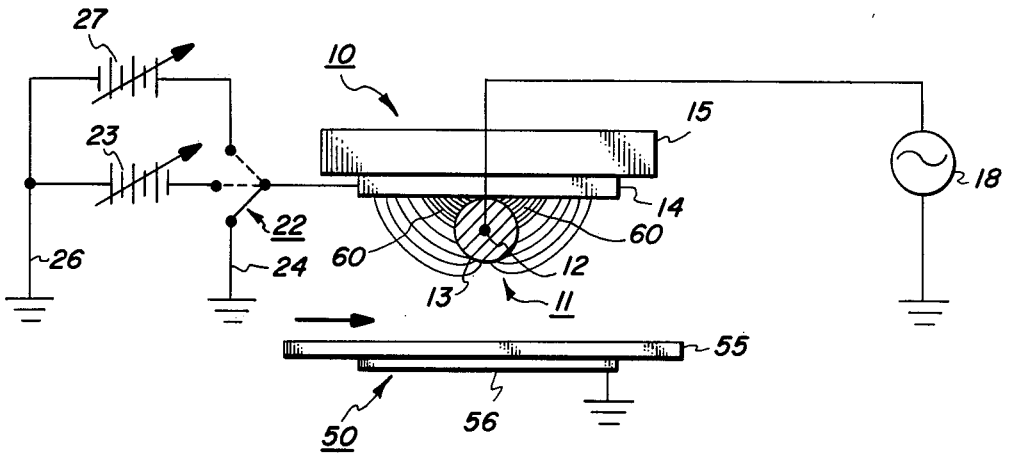
FIG. 1 is an illustrative cross-section of the corona charging arrangement of the invention.
Figure 2:
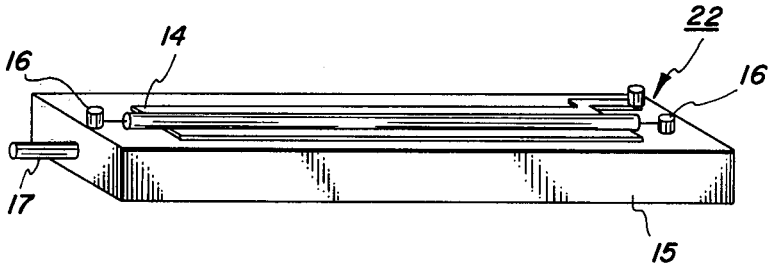
FIG. 2 is a perspective view of one embodiment of the invention.

Referring to FIGS. 1 and 2 of the drawings in which one embodiment of the invention is shown, the corona device 10 of the invention is illustrated as being supported adjacent to an imaging member 50 of a conventional xerographic reproduction machine. The details of construction of the imaging member 50 are well known in the art and do not form a part of this invention. Briefly, however, the imaging member 50 conventionally comprises a photoconductive surface 55 carried by a conductive substrate 56. During operation of the xerographic system, the conductive substrate 56 is held at a reference potential, usually machine ground. During a typical cycle of a xerographic reproduction machine, the imaging member is subjected several times for diverse purposes to charge depositions by corona devices.

The corona generator of the invention includes a coronode or corona discharge electrode 11 in the form of a conductive wire 12 having a relatively thick dielectric coating 13. The wire 12 and coating 13 are shown as having circular cross section, but other cross sections, such as square or rectangular, may be used satisfactorily.

The coronode 11 is supported in contact with a conductive biasing member or shield 14, the member 14 being attached to, deposited on or carried by a dielectric support block 15. The member 14 may take the form of a thin sheet of metal or a metal plate attached to the block 15. The member 14 includes an exposed flat surface facing and in contact with the coronode 11. The member 14 is provided at any convenient portion thereof, preferably outside of the corona discharge area, with a terminal or suitable connection for applying an electrical potential thereto, as illustrated in FIG. 2 at 22. As can best be seen in FIG. 2, the wire 12 may be attached near the ends thereof to posts 16, one of which is in conductive communication with a plug or terminal 17 via which a corona generating potential is applied, as will be explained in greater detail hereinafter. All portions of the terminals 16 and wire 12 outside of the corona discharge region are preferably coated with a thick dielectric or insulating material to prevent arcing to adjacent surfaces. The wire 12 is connected to the posts 16 in such a manner as to hold the dielectric coating 13 in contact with the member 14 along a major portion of the coronode 11.

In the arrangement of FIG. 2, it is seen that the block 15 serves to provide a rigid support for both the electrode 11 and the conductive member 14. The imaging surface 50 is arranged on the side of the coronode 11 opposite the conductive member 14 and support block 15.

The electrical energization scheme of the corona device of this invention is similar to that disclosed in the aforementioned application Ser. No. 595,656, and the disclosure of that application is hereby incorporated into this application by reference. An a.c. voltage source 18 is connected between the substrate 56 and the corona wire 12, the value of the a.c. potential being selected to generate a corona discharge adjacent the electrode 11.

The biasing member or shield 14 operates to control the magnitude and polarity of charge delivered to the surface 50. To that end, the member 14 has coupled thereto a switch 22 which, depending on its position, permits the corona device to be operated in either a charge neutralizing mode or a charge deposition mode. With the switch 22 in the position shown, the member 14 of the corona device is coupled to ground via a lead 24. In this position, no d.c. field is generated between the biasing member 14 and the surface 50 With the switch 22 in the lower dotted line position, source 23 is connected and negative charge is driven to the photoconductor surface 50, as will be explained in greater detail hereinafter, the magnitude of the charge deposited depending on the value of the applied potential. In the other dotted line position of switch 22, the positive terminal of a d.c. source 27 is coupled to the member 14. Under these conditions, the corona device operates to deposit a net positive charge onto the surface 50, the magnitude of this charge dependent on the magnitude of the d.c. bias applied to the biasing member 14.

The wire 12 may be made of any conventional conductive filament materials such as stainless steel, gold, aluminum, copper, tungsten, platinum or the like. The diameter of the wire 12 is not critical and may vary typically between 0.5–15 mil. and preferably is about 3–6 mils.

Any suitable dielectric material may be employed as the coating 13 which will not break down under the applied corona a.c. voltage, and which will withstand chemical attack under the conditions present in a corona device. Inorganic dielectrics have been found to perform more satisfactorily than organic dielectrics due to their higher voltage breakdown properties, and greater resistance to chemical corrosion in the corona environment, and ion bombardment.

The thickness of the dielectric coating 13 used in the corona device of the invention is such that substantially no conduction current or d.c. charging current is permitted therethrough. Typically, the thickness is such that the combined wire and dielectric diameter falls in the range from 3.5–50 mil with typical thickness of the dielectric of 1.5–25 mil with sufficiently high dielectric breakdown strengths. Several commercially available glasses have been found by experiment to perform satisfactorily as the dielectric coating material. The glass coating selected should be free of voids and inclusions and make good contact with or wet the wire on which it is deposited. Other possible coatings are ceramic materials such as Alumina, Zirconia, Boron Nitride, Beryllium Oxide and Silicon Nitride. Organic dielectrics which are sufficiently stable in corona may also be used.

The frequency of the a.c. source 18 may be varied widely in the range from 60 hz. commercial source to several megahertz. The device has been operated and tested at 4 KHz, and also been found to operate satisfactorily under conditions typical of the xerographic process in the range between 1 KHz and 50 KHz.

Figure 5:
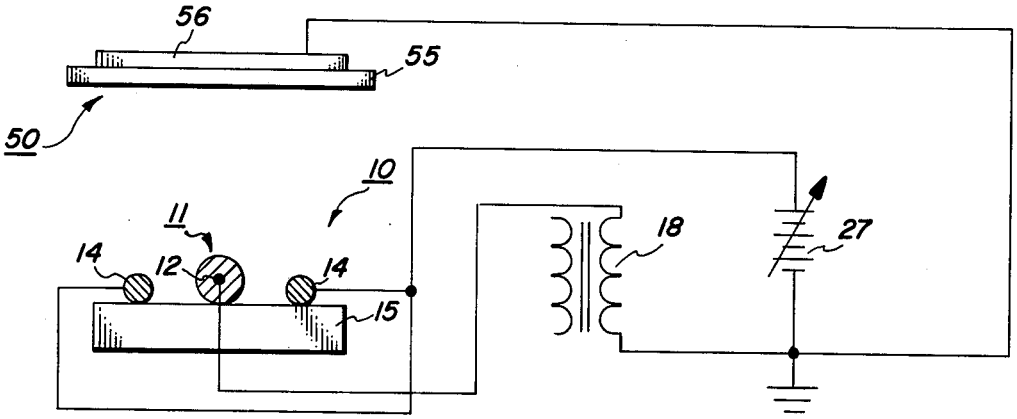
FIG. 5 illustrates another embodiment of the invention in which the conductive shield elements are spaced from the corona electrode and FIG. 6 illustrates some alternative electrical energization arrangements for the invention.

The biasing member or shield 14 has been shown as being flat and rectangular in shape. Different shapes may be employed with satisfactory results. FIG. 5 shows a variation in shield configuration and location and will be discussed hereinafter.

Typical dimensions and construction details for a device according to FIG. 1 of this invention are as follows:

| Element | Dimensions | Material |
|---|---|---|
| Substrate or block 15 | $3 \times 1/2 \times 45$ cms | Lucite or other insulating material |
| Shield 14 | $1 \times 2.5 \times 10^{-3} \times 40$ cms | Aluminum, Nickel or other easily evaporated metal |
| Wire 12 | O.D. $= 7.5 \times 10^{-3} \times 45$ cms long | Same as for shield or Tungsten wire |
| Dielectric Coating 13 | O.D. $= 7.5 \times 10^{-2} \times 45$ cms long | Glass or other evaporable or coatable dielectric |

OPERATION AS NEUTRALIZING DEVICE

With the switch 22 connected as shown so that the shield 20 is grounded, the device operates to inherently neutralize any charge present on the surface 55. This is a result of the fact that no net d.c. charging current passes through the electrode 11 by virtue of the thick dielectric coating 13 on the wire 12.

The operation of the corona device of this invention in the neutralizing mode is the same as the operation of the device disclosed in Ser. No. 595,656 and has the same desirable property of delivering no net d.c. charging current to an adjacent surface when that surface is held at the same potential as the biasing member or shield. The reason for this property, as was discussed in greater detail in the aforementioned application, is that the thick dielectric coating on the wire takes on a net charge to compensate for greater mobility of negative charges. This net charge forces the corona device to deposit equal positive and negative charges onto the charge collecting surface over each a.c. cycle. In the device of this invention, this charge build-up also operates to hold the electrode 11 in tight contact with the shield 14.

Thus, a surface such as 55 of FIG. 1, will be completely neutralized by the corona device 10 (with switch 22 in the solid line position) if permitted to stay in charge receiving relationship therewith for a sufficient period of time.

Figure 3:
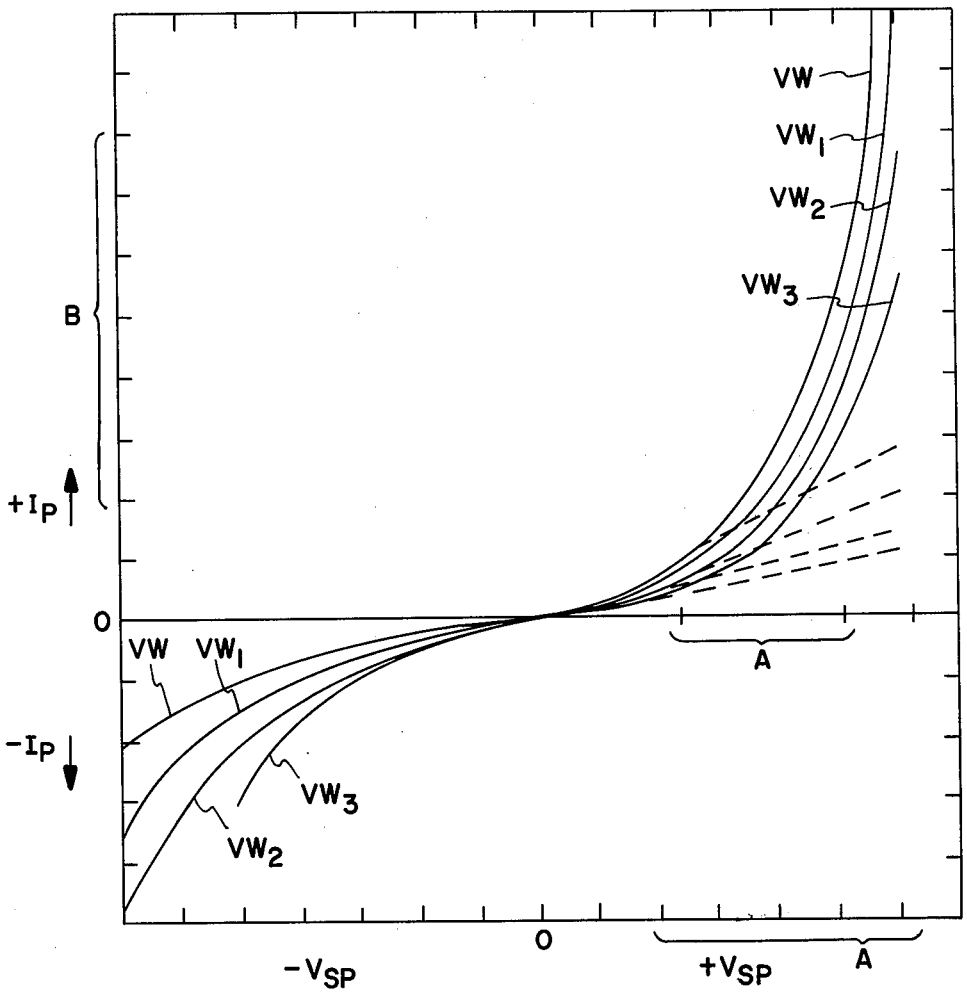
FIG. 3 is a graph showing d.c. current delivered by a device according to the invention as a function of bias potential between the shield and substrate supporting the surface to be charged at various wire a.c. excitation potentials.

A better understanding of why the corona device of this invention operates to completely neutralize an adjacent charged surface can be had from FIG. 3 which shows characteristic curves of the device.

In FIG. 3, the d.c. charging current $I_p$ delivered by the corona device of the invention is shown as a function of the shield 14 to conductive plate (56) potential, Vsp, at various a.c. energizing potentials Vw.

It should be noted at this point that FIG. 3 is presented primarily to foster an understanding of the typical characteristics of the corona device of the invention and is not intended to represent the characteristics of any particular configuration, such specific values being a function of a variety of parameters.

Consistent with our discussion above of the operation of the corona device of the invention as a charge neutralizing device, it is seen from FIG. 3 that the charging current $I_p$ is zero when the potential between the plate 56 and the member 14 is zero. This is, of course, in contrast to prior art devices which deliver a net negative charge to a chargeable surface held at the same potential as the surrounding shield. This characteristic holds true independent of the wire exitation potential, Vw, as seen in FIG. 3.

OPERATION TO DEPOSIT NET CHARGE

The operation of the corona device of the invention to deposit a specific net charge on an imaging surface is accomplished by moving switch 22, FIG. 1, to either of the positions shown in dotted lines, whereby a variable d.c. potential of either positive or negative polarity with respect to the surface 56 may be applied to the shield member 14.

With the switch 22 operated to couple source 23 to the shield 14, Vsp, the potential between the shield 14 and the conductive plate 56 is negative. With the switch 22 operated to couple source 27 to a shield 14, Vsp is positive. It can be seen from FIG. 3 that with Vsp positive (source 27 connected to shield 14) charging circuit from the corona device is positive and increases slowly and linearly at low values of Vsp then increases exponentially at higher values of Vsp. A similar rise in negative charging current $I_p$ is noted when the source 27 is coupled to the shield 14 and its value increases progressively in the negative direction.

To get a more precise appreciation of the values shown in FIG. 3, range B is generally between 4 and 20 $\mu$ A/cm length of electrode and range A is generally between 2 and 6 KV, with $Vw-Vw_3$ being in the range from 2,000 to 2,700 volts, a.c., respectively. Thus, this exponential rise in charging current permits the obtainment of relatively large charging circuit using practical biasing potentials.

This exponential rise in charging current, $I_p$, as a function of increasing bias potential from shield to plate, Vsp, is an obvious advantage in situations where rapid charging of a photoreceptor is desireable, as in the initial charging of a photoreceptor in the xerographic process. As the process speeds of xerographic system rise, the ability to deposit such high levels of charging current is extremely important.

The exponential rise in the charging current noted above may be contrasted generally to the rise in current from prior art corona devices and corona devices of the type shown in application, Ser. No. 595,656, which are illustrated in FIG. 3 in dotted lines. As can be seen, the dotted lines characteristics rise generally linearly with increases in the shield to plate bias potential.

The final balue of the potential to which collecting surface 55 is brought by the corona device of the invention is equal to magnitude and polarity to the bias applied to the shield Vs. Thus, if the switch 22 of FIG. 1 were connected to apply a positive potential of +X volts to the shield, the imaging surface 55 would be charged to a potential of X volts (assuming a long enough exposure time). If the shield is biased with a voltage of −X volts, the surface 15 charges toward a final voltage of −X volts. When the surface to be charged reaches a potential which is equal to that applied to the shield, no further charging current is drawn and the charge on the surface remains unchanged thereafter. Thus, the device of the invention operates in a manner similar to the charging device shown in U.S. Pat. No. 2,879,395 and also to the device in the aforementioned application. While the final charge attained is the same, the rate of charge deposition from this device of the invention is very much larger, as illustrated in FIG. 3.

The above characteristic of bringing the potential of the chargeable surface to a steady state or final value equal to the bias potential on the shield can be seen from the curves of FIG. 3 which indicate that the charging current Ip approaches zero as the difference between the plate potential and the shield potential approaches zero.

The operation of the shield bias voltage Vsp in determining the final net charge on an adjacent surface may be understood from the following explanation. Assume initially that both the shield 14 and the surface to be charged 55 are at ground potential (vsp=0). Under these conditions, although the corona discharge continuously produces positive ions, negative ions, and electrons, there is no appreciable net current to either the shield or the charge receptor. This is true because on the negative half cycle of the a.c. potential applied to the coronode, the shield receives almost all the negative charge, while on the succeeding positive half cycle, an equal amount of positive charge is delivered to the shield. This condition, as explained previously, is a consequence of the thick dielectric coating which does not permit a net d.c. coronode current. Without a dielectric coating, a net current would occur, since the positive and negative charge carriers have different mobilities. In the present invention, the surface of the dielectric coating acquires a net charge which just counterbalances the effect of the difference in mobilities. This action is inherent in the device, and the surface charge will automatically adjust to the proper value, even compensating for changes in humidity, temperature, pressure, and other variations in gas properties to which the device might be subjected. Thus, where Vsp=O, any charge carried by the surface 55 will be reduced to zero. If the surface is neutralized to begin with, it will remain so.

When a voltage Vsp is applied to the shield, an electric field is generated between the shield and the surface to be charged. This electric field separates the positive and negative charges and drives them to the respective surfaces. Positive charges move to the negatively biased surface and negative charges move to the positively charged surface. With the shield biased positively with respect to the charge receptor surface, a significant fraction of the positive ions adjacent the wire is directed toward the charge receptor surface on the positive half cycle of the potential applied to the coronode. Similarly, on the negative half cycle, an insignificant fraction of negative charges is directed toward the charge receptor surface. These combined actions result in a net d.c. current to the charge receptor surface, and an equal and opposite current to the shield. This process continues until the surface 55 reaches the shield potential, and Vsp is reduced to zero. The converse of the above-noted action takes place when a negative potential is applied to the shield with respect to the charge receptor surface via conductive plate 56.

OUTSTANDING CHARACTERISTICS

As was noted hereinbefore, the corona device of this invention has many outstanding advantages, several of which it shares in common with the corona device of the application Ser. No. 595,656. The common advantages will be described herein only briefly as follows:

The corona device of the invention does not degrade as rapidly as prior art devices from the chemical growths occurring on its surface. In fact, testing has suggested that the useful life of a corona device constructed in accordance with the invention may be conservatively said to be 3 to 4 times longer than conventional corona devices.

While the reasons surrounding this unexpected increase in useful life are not fully known, the following is believed to contribute to these results. Although growths proceed at about the same rate on both metal and glass surfaces, growths on a metal surface change the nature of the surface and ultimately inhibit corona at the growth sites. On the other hand, growths on a dielectric or glass surface serve merely as extensions of the dielectric surface and consequently do not significantly affect corona.

Furthermore, some growths are believed to be caused in part by localized "punch-through" or breakdown effects resulting from the build up of a charge across an insulating type of deposit or growth. When the charge across the deposit becomes great enough, a localized discharge occurs across the deposit which causes even more serious growths. The above noted effects are eliminated in the corona device of the invention by the provision of the thick dielectric coating, the breakdown field of which is not exceeded during operation of the device.

Still another factor related to chemical growths on the electrode is surface texture. Evidence suggests that rough wire surfaces tend to form growths more easily. Since the dielectric coating according to the invention may be deposited by various coating techniques, a more smooth outer surface is possible. This is particularly true of glass dielectric where an optically smooth surface is possible.

The corona device of the invention has also been found to accumulate less toner in use in a xerographic environment and to be less affected by such accumulation. Less toner is deposited on the shield of the corona device of the invention operated with a shield bias because of the action of the electric fields on the toner. Furthermore, since the corona device of the invention is usually operated at a frequency of above 1 KHz., there is a tendency to deposit less net charge on a circulating toner particle, thereby reducing its tendency to be attracted to a surface. Experimental data also has shown that the toner which is deposited on the surfaces of a corona device according to the invention has less effect on the output and uniformity of the device, as compared to prior art devices.

Partly the result of the favorable characteristics noted above with respect to toner accumulation and chemical growth, and partly due to factors not yet understood, the corona device of the invention has exhibited an outstanding improvement in the uniformity of negative charge deposited on a photoreceptor. In prior art bare wire corona devices, the magnitude of charge delivered from discrete areas along the length of the wire may vary between ∓75% when energized by a negative d.c. corona generating potential. Contrasted to this, when the device according to FIG. 1 is operated with a negative shield bias (source 23 connected), a variation of only ∓3% in deposited charge density along the length of chargeable surface parallel to the wire has been obtained, which is comparable to prior art bare wire corona devices energized by a positive d.c. potential.

The above characteristics as noted hereinbefore, are shared in common with the device of Application Ser. No. 595,656. The following are advantages of the corona device of this invention in addition to those associated with the prior mentioned application.

A.

Lower Threshold Potentials

The corona device of this invention has been found to have a threshold wire potential (the potential on the wire at which corona discharge begins) which is a factor of 5 smaller than bare wire corona devices of the prior art and the corona device of application Ser. No. 595,656 having electrode of the same outer diameter. A first advantage of this is that the power supplies needed to operate the device are less complex, and expensive owing to the lower operating potentials. Additionally, lower operating voltages tend to produce less ozone, a very desireable characteristic. The low corona threshold potential for the corona device of the invention is a consequence of the close spacing between the field producing member. This close spacing generates a high electric field intensity in the regions 60, FIG. 1, intermediate the electrode and the shield. Since threshold potential is a function of electric intensity, this concentrated electric field results in a reduced threshold potential.

B. Compact Size

Since the electric field in the region 60 adjacent the electrode 11 is very concentrated by virtue of the configuration of the corona device, the shield element 14 itself may be made small compared to the shield structure of prior art devices. For example, whereas the corona shields of prior art arrangements are typically on the order of 2 cm., the shield 14 may be as small as a few millimeters. The reduced size of this is possible as a result of the increased electric field intensity produced by the closely spaced elements. This, in combination with the reduction in size due to the placement of the electrode 11 in contact with the shield, makes for a very compact corona device.

C. Structural Rigidity

Another advantage of the corona device of the invention results from its rigidity. Since the electrode 11 rests firmly on the shield 14, vibration of the electrode is virtually eliminated. This is in stark contrast to prior art devices in which the electrode is suspended between insulating end blocks and tends to vibrate appreciably in operation. The rigidity of the electrode support arrangement also permits easier cleaning of the surface of the electrode by rubbing it with an abrasive material. Prior art cleaning devices of necessity had to be designed with undue consideration given to avoiding breakage or loosening of the electrode. These problems are alleviated to a great extent with the corona device of the invention.

While the invention has been shown and described with reference to the preferred embodiment thereof, it should be understood by those skilled in the art that changes in form and detail may be made without departing from the spirit and scope of the invention. For example, the insulating block 15 of FIG. 1 is used simply to provide an insulated support for the shield 14 and coronode 11. The block 15 may be entirely eliminated and the shield 14 made in the form of a conductive rectangular plate similar in shape to the block 15 suitable for supporting the electrode 11. In this configuration, however, an insulative coating would usually be required over the plate to insulate machine operators and service technicians from the high potentials applied to the plate, which may be several thousand volts and thus pose a safety hazard.

The electrode 11 instead of being supported adjacent the shield 14 by the ends of the wire 12 may instead be glued to the shield by a thin layer of epoxy or other suitable adhesive. This configuration would permit an even thinner wire 12 to be employed, since the wire would be relieved of its support function.

Figure 4:
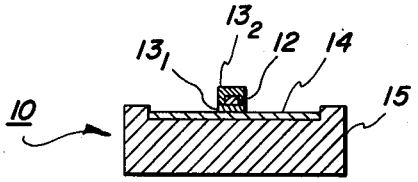
FIG. 4 is a form of the invention constructed by evaporating elements onto a substrate in sequential fashion.

Additionally, the conductive member 14, the dielectric coating 11, and the wire 12, may be produced in a configuration conforming to the principles stated in this invention by evaporating the materials of the respective members in a sequential fashion. Referring to FIG. 4 in which the reference numbers identify elements which are functionally equivalent to like numbered elements of FIGS. 1 and 2, a conductive member 14 is first evaporated onto the dielectric support block 15. Then a first thin dielectric layer 13 of dimensions typical to this invention is evaporated centrally and along the length of the member 14. This is followed by the evaporation of a conductive material 12 of dimensions typical to this invention to partially overcoat the insulator layer 13. Lastly, an overlayer 13 of dielectric material is evaporated over the wire material 12. Suitable terminals are provided for applying operating potentials to the elements 14 and 12.

While in the embodiment of FIG. 1 the electrode 11 has been illustrated as being in contact along its entire length with the shield element 14, it is to be understood that the shield may be segmented or broken transversely of the wire 12 with biasing potentials applied to each segment without departing from the scope of the invention.

In addition, the advantages of the invention, including the exponential current characteristics are retained even though the electrode is spaced a very small distance from the shield element and even though the shield elements take on shapes other than planar. FIG. 5, for example, illustrates a modified form of the invention in which reference numbers are used to identify elements which are functionally equivalent to like numbered elements of FIGS. 1 and 2. The corona discharge electrode 11 includes a wire 12 and dielectric coating 13, the wire being energized from an a.c. source 18. The biasing shields or control members 14 are spaced from the electrode 11 and are in the form of wires extending parallel to the electrode 11 along the device. The shield members 14 are coupled to a d.c. electric field establishing potential 27. The surface to be charged 55 is supported on a grounded substrate 56 adjacent the charging device 10. The wires 14 and electrode 11 are supported on a common planar surface of the dielectric block 15. The wires 14 must be spaced very closely to the electrode in order to retain the current characteristics noted in FIG. 3. While the maximum distance between the members 14 and the electrode 11 is dependent in part on geometry of the device and the operating potentials, the underlying goal is to maintain a sufficiently concentrated or high density electric field in the space intermediate the wires 14 and electrode 11. A spacing up to a few electrode diameters, at the maximum, will operate satisfactorily. This translates typically into a distance of up to about 0.15 cm.

Figure 6:
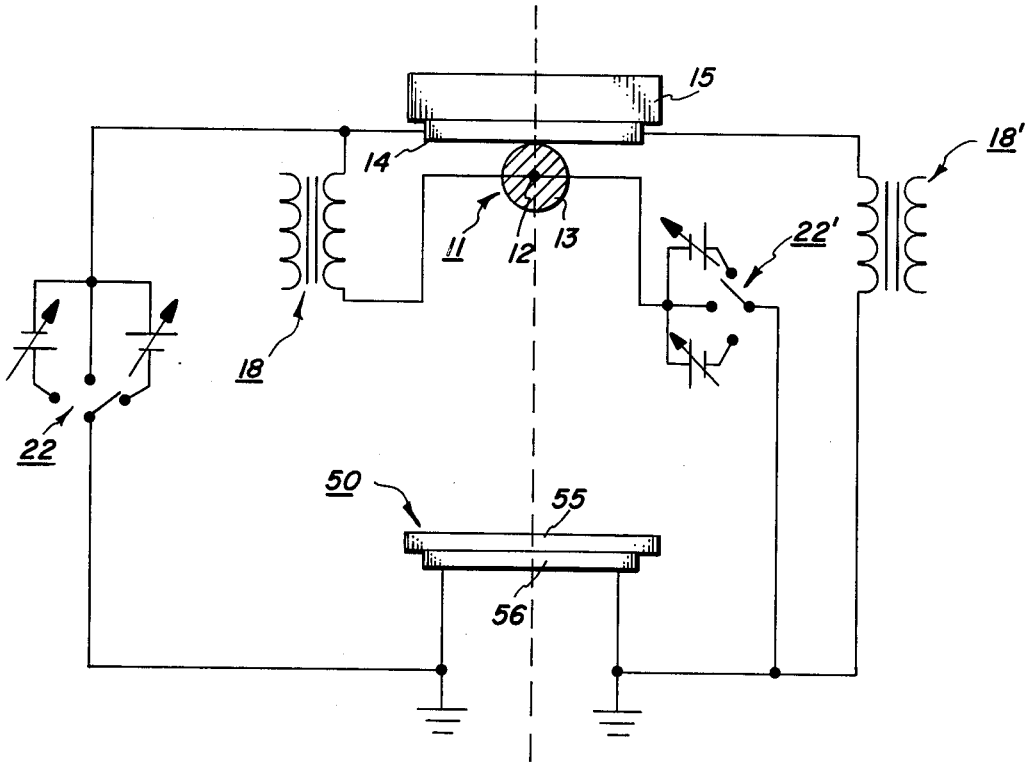

Two alternate electrical energization schemes are shown in FIG. 6 on opposite sides of the dotted lines. In one scheme, shown to the left of the dotted line, the a.c. corona energizing signal is connected between the shield 14 and the wire 12. A reference potential is connected between the shield member 14 and the substrate 56, which is grounded. The reference potential which can be positive or negative d.c. or ground is applied to the shield 14 by connecting the switch 22 to one of its three alternate positions as shown in the drawing.

The other electrical energization scheme shown to the right of the dotted line in FIG. 6, places the a.c. corona energizing potential between the shield member 14 and the grounded substrate 56. The wire 12 is held at either a positive or negative d.c. potential, or at ground potential by selecting one of the three alternate positions of switch arrangement 22'. This latter scheme is useful for low current operation or bipolar charge deposition. To those skilled in the art, it is apparent that various combinations of the two schemes can be usefully employed.

While the embodiments of the invention have shown a single corona electrode 11, it should be understood that a plurality of electrodes may be employed.

What is claimed is:

1. A corona device comprising:

a conductive member;

a corona electrode in contact with or spaced from said member no more than about 0.15 cm to produce exponential-like current characteristics, said electrode comprising a conductive wire coated with a thick dielectric material, the thickness of the dielectric being sufficient to prevent the flow of conduction current through said wire, said member being electrically insulated from said wire, and means for applying an a.c. corona generating voltage to said wire to establish a corona discharge at the surface of said electrode and means for applying a d.c. reference potential to said member.

2. The combination recited in claim 1 further including an imaging surface, said electrode located intermediate said member and said surface.

3. The combination recited in claim 1 wherein said member comprises a flat plate.

4. The combination recited in claim 3 further including an imaging surface, and said electrode is located intermediate said surface and said member.

5. The combination in claim 1 wherein said coating is glass.

6. The combination recited in claim 5 wherein said member is a flat plate.

7. The combination recited in claim 6 further including an imaging surface and wherein said electrode is located intermediate said surface and said plate.

8. The combination recited in claim 1 wherein said reference potential is ground and said A.C. potential oscillates symmetrically about said reference potential.

9. The combination recited in claim 2 wherein said imaging surface comprises a photoconductive layer carried on a conductive substrate, said A.C. potential varies symmetrically about a constant common potential and said reference potential is a constant D.C. potential above or below said common potential.

10. The combination recited in claim 1 wherein said corona electrode is supported by said conductive member.

11. The combination recited in claim 1 further including a dielectric support, said member and said electrode fixedly carried by said support.

12. In combination:

a conductive member;

a corona electrode spaced from said member no more than about 0.15 cm, said electrode comprising a conductive wire coated with a thick dielectric material, the thickness of the dielectric being sufficient to prevent the flow of conduction current through said wire;

an imaging surface carried on a conductive substrate, said surface located adjacent said electrode, means for establishing a corona producing a.c. electric field adjacent said electrode; and means for generating a d.c. electric field in the space intermediate said wire and said substrate.

13. The combination of claim 12 wherein said coating is glass.

14. The combination recited in claim 13 wherein said member is a flat plate.

15. The combination recited in claim 12 wherein said corona electrode is supported by said conductive member.

16. The combination recited in claim 12 further including a dielectric support, said member and said electrode fixedly carried by said support.

17. A corona device for depositing charge on a chargeable surface comprising:

a conductive member;

a corona electrode in contact with said conductive member, said electrode comprising a conductive wire coated with a thick dielectric material, said dielectric preventing the flow of conduction current through said wire;

means for generating a corona causing a.c. field adjacent the surface of said electrode; and means for generating d.c. fields between the chargeable surface and the electrode and between the conductive member and the electrode, whereby charge is moved from the area adjacent said electrode as a function of the relative strength of said d.c. fields.

18. A corona charging arrangement for depositing charge on a photoconductive imaging surface comprising:

an electrode including a conductor coated with a thick dielectric, the dielectric acting to prevent the flow of conduction current therethrough, said imaging surface located adjacent said electrode and carried on a conductive substrate, said imaging surface located adjacent said electrode and carried on a conductive substrate, a conductive member in contact with said electrode, means for applying an a.c. corona generating field to create a corona discharge adjacent the surface of said electrode, and means for applying a d.c. potential between said substrate and said member to produce a charge directing field to move charge from the surface of said electrode toward said imaging surface.

19. The combination recited in claim 18 wherein said dielectric is glass.

20. The combination recited in claim 18 wherein the last named means comprises means for applying a d.c. field between said member and said surface.

21. The combination recited in claim 18 wherein said surface is a photoconductive material.

22. In a reproduction machine including a charge accepting imaging surface and a corona device for depositing charge on said surface, said corona device comprising an electrode including a wire coated with a dielectric material to prevent the passage of a d.c. current therethough the improvement comprising a conductor, means for directly supporting said electrode along substantially the entire charge generating portion thereof in contact with said conductor, means for applying an a.c. corona generating field between said conductor and said electrode to produce a corona discharge at the surface of said electrode and means for producing a d.c. field between said conductor and said surface to deposit net charge on said surface.

23. The combination recited in claim 22 wherein said means for supporting comprises an insulator.

24. The combination recited in claim 23 wherein said insulator also supports said conductor.

* * * * *

UNITED STATES PATENT OFFICE
CERTIFICATE OF CORRECTION

PATENT NO. : 4,057,723

DATED : November 8, 1977

INVENTOR(S) : Dror Sarid; Brian E. Springett

It is certified that error appears in the above-identified patent and that said Letters Patent are hereby corrected as shown below:

Column 2, line 15, "charges" should read "charged".

Column 6, line 62, "exitation" should read "excitation".

Column 7, line 23, "circuit" should read "current".

Column 7, line 40, "balue" should read "value".

Column 7, line 42, "equal to" should read "equal in".

Column 13, lines 31-34, the second occurrence of the phrase "said imaging surface ... substrate" should be deleted.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*